US010323529B2

(12) United States Patent
Ahn

(10) Patent No.: US 10,323,529 B2
(45) Date of Patent: Jun. 18, 2019

(54) TURBINE INCLUDING PACKING DEVICE AND METHOD OF ASSEMBLING THE SAME, AND SEALING ASSEMBLY

(71) Applicant: DOOSAN HEAVY INDUSTRIES & CONSTRUCTION CO., LTD., Changwon-si, Gyeongsangnam-do (KR)

(72) Inventor: Jun Ho Ahn, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 888 days.

(21) Appl. No.: 14/811,977

(22) Filed: Jul. 29, 2015

(65) Prior Publication Data

US 2016/0032745 A1 Feb. 4, 2016

(30) Foreign Application Priority Data

Jul. 31, 2014 (KR) ..... 10-2014-0098281

(51) Int. Cl.

| | |
|---|---|
| ***F01D 11/00*** | (2006.01) |
| ***F01D 25/28*** | (2006.01) |
| ***F01D 25/16*** | (2006.01) |
| ***F01D 25/24*** | (2006.01) |

(52) U.S. Cl.

CPC ..... *F01D 11/003* (2013.01); *F01D 25/16* (2013.01); *F01D 25/24* (2013.01); *F01D 25/285* (2013.01); *F05D 2260/02* (2013.01); *F05D 2260/30* (2013.01)

(58) Field of Classification Search

CPC ..... F01D 11/003; F01D 25/26; F01D 25/164; F01D 25/24; F01D 25/285; F01D 25/28; F01D 11/02; F01D 11/045; F01D 25/162

See application file for complete search history.

(56) References Cited

U.S. PATENT DOCUMENTS

| | | | | |
|---|---|---|---|---|
| 3,927,763 | A | 12/1975 | Strub et al. | |
| 4,032,255 | A | 6/1977 | Iizuka et al. | |
| 4,429,883 | A * | 2/1984 | Nakanishi | F01D 11/02 277/412 |
| 2014/0178183 | A1 | 6/2014 | Masuda et al. | |

OTHER PUBLICATIONS

European Office Action in connection with EP Application No. 15178484.0 dated Jan. 8, 2016.

* cited by examiner

*Primary Examiner* — Justin D Seabe
*Assistant Examiner* — Sabbir Hasan
(74) *Attorney, Agent, or Firm* — Invenstone Patent, LLC

(57) ABSTRACT

A turbine includes a rotor shaft having a plurality of rotating blades mounted on the rotor shaft, a bearing assembly rotatably supporting the rotor shaft, a casing forming a passage of a fluid and to include a space in which the rotating blades are disposed so that thermal energy of the fluid is converted into mechanical energy by rotation, a foundation fixedly supporting the bearing assembly, and a packing device installed in the rotor shaft for sealing between the casing and the rotor shaft and supported by the foundation. The casing comprises a connection unit extended toward the packing device and fixed to the casing so that a location of the connection unit is relatively changed with respect to the packing device. Accordingly, there is an advantage in that the leakage of a fluid is reduced because a clearance between the packing device and the rotor shaft is reduced.

12 Claims, 12 Drawing Sheets prior art prior art

TURBINE INCLUDING PACKING DEVICE AND METHOD OF ASSEMBLING THE SAME, AND SEALING ASSEMBLY

CROSS REFERENCE TO RELATED APPLICATION

This application claims priority to Korean Application No. 10-2014-0098281, filed on Jul. 31, 2014, the contents of which are incorporated herein in their entirety.

BACKGROUND

1. Technical Field

An embodiment of the present invention relates to a turbine and, more particularly, to a turbine including a packing device between the rotor shaft and casing of the turbine and a method of assembling the turbine.

Furthermore, an embodiment of the present invention relates to a sealing assembly and, more particularly, to a sealing assembly installed between the casing and packing device of the turbine.

2. Description of the Related Art

A turbine is a power generation apparatus for converting thermal energy of a fluid, such as high-temperature and high-pressure steam or gas generated by a boiler or steam generator, into rotatory power, that is, mechanical energy, and is an apparatus that may be used to generate electric power by driving an electric generator.

Referring to FIG. 1, a conventional turbine includes a turbine rotor 10 configured to have a plurality of rotating blades 12 mounted on a rotor shaft 11 and a bearing 50 configured to rotatably the rotor shaft to a base stand 20. The plurality of rotating blades is arranged along the passage of a fluid. A plurality of fixing blades (not illustrated) is provided between the plurality of rotating blades and configured to induce thermal energy of a fluid to be converted into rotatory power. In the flow direction of a fluid, a fluid guide 31 is provided on the downstream side.

The conventional turbine further includes a casing 30 configured to accommodate, protect, and support various elements, such as a turbine rotor, and to maintain internal pressure. Both ends of the rotor shaft 11 are extended to the outside of the casing. The bearing 50 is fixed to the base stand 20 outside the casing 30, and rotatably supports the rotor shaft. Since the rotor shaft 11 is extended outside the casing 30, a packing ring 41 is provided between the rotor shaft 11 and the casing 30, thus preventing a fluid from leaking. The packing ring 41 is supported by a support unit 42 fixedly connected to the casing 30.

As indicated by arrows in FIG. 2, if internal pressure in the casing 30 is changed, the casing may be moved. For example, internal pressure may be changed by vacuum pressure generated by a part, such as a condenser included in the casing. In this case, the packing ring 41 fixedly connected to the casing 30 is also moved. In contrast, since the rotor shaft 11 is supported by the base stand 20, the location of the rotor shaft 11 is not changed although the casing 30 is deformed.

As described above, the casing is deformed in response to a change in the internal pressure of the casing, whereas the location of the rotor shaft is not changed. Accordingly, it is necessary to design the packing ring so that the packing ring and the rotor shaft have a clearance by taking into consideration deformation of the casing.

Accordingly, the amount of an internal fluid that leaks from the inside of the casing to the outside of the casing or the amount of an external gas or external fluid that flows from the outside of the casing to the inside of the casing is affected by the size of the clearance. As a result, efficiency of the turbine is influenced.

The conventional turbine is problematic in that the leakage of a fluid within the casing or the introduction of a fluid or gas outside the casing is generated between the packing ring and the rotor shaft because the size of the clearance must be increased by taking into consideration a relative location movement between the packing ring and the casing.

SUMMARY

Accordingly, the present invention has been made keeping in mind the above problems occurring in the prior art, and an object of the present invention is to provide a turbine capable of being fabricated with a minimized clearance between a packing ring and a rotor shaft because deformation of a casing does not have an influence on a movement in the location of the packing ring although the casing is deformed and thus there is no relative location movement between the packing ring and the rotor shaft and capable of reducing the leakage of a fluid within the casing or the introduction of a fluid or gas outside the casing owing to a reduction of the clearance and a method of assembling the turbine.

Furthermore, another object of the present invention is to provide a sealing assembly capable of sealing the space between a packing device and a connection unit although there is a relative location movement between the casing and the packing device due to deformation of the casing.

A turbine in accordance with an embodiment of the present invention includes a rotor shaft configured to have a plurality of rotating blades mounted on the rotor shaft, a bearing assembly configured to rotatably support the rotor shaft, a casing configured to form the passage of a fluid and to include a space in which the rotating blades are disposed so that thermal energy of the fluid is converted into mechanical energy by rotation, a foundation configured to fixedly support the bearing assembly, and a packing device installed in the rotor shaft for sealing between the casing and the rotor shaft and supported by the foundation, wherein the casing includes a connection unit extended toward the packing device and fixed to the casing so that the location of the connection unit is relatively changed with respect to the packing device.

In accordance with an embodiment of the present invention, the casing further includes the discharge guide of the fluid provided on the downstream side of the passage of the fluid. The connection unit is extended from the discharge guide to the packing device.

In accordance with an embodiment of the present invention, the connection unit includes a taper unit extended in the length direction of the rotor shaft.

In accordance with an embodiment of the present invention, the taper unit has a shape in which the taper unit is narrowed toward the downstream side of the passage of the fluid.

In accordance with an embodiment of the present invention, a first opening and a second opening having a smaller diameter than the first opening are formed in the taper unit. The taper unit includes a taper wall extended from the first opening to the second opening in such a way as to surround the rotor shaft. The second opening side of the taper wall is disposed in the packing device, and the first opening side of the taper wall is fixed to the casing.

In accordance with an embodiment of the present invention, the taper unit further includes an extension wall extended from the second opening side of the taper wall to the rotor shaft and extended along the side of the packing device.

In accordance with an embodiment of the present invention, the turbine further includes a sealing assembly formed between the second opening side and the packing device.

In accordance with an embodiment of the present invention, the connection unit further includes an elastic unit disposed between the taper unit and the packing device, fixed to the taper unit, and configured to have an elastic force.

In accordance with an embodiment of the present invention, the elastic unit includes a circular gasket in which wrinkles are formed.

In accordance with an embodiment of the present invention, the gasket has an outer circumferential surface fixed to the taper unit and has an inner circumferential surface surround the packing device.

In accordance with an embodiment of the present invention, the packing device includes a packing ring installed to surround the outer circumferential surface of the rotor shaft.

In accordance with an embodiment of the present invention, the bearing assembly is provided on the side adjacent to the downstream side of the passage of the fluid outside the casing. The packing ring is disposed between the connection unit and the bearing assembly.

In accordance with an embodiment of the present invention, at least part of the packing ring is fixed and supported to the foundation.

In accordance with an embodiment of the present invention, the packing device further includes a connection housing configured to couple the packing ring and the bearing assembly, and the foundation supports the connection housing.

The connection housing includes a packing ring insertion hole into which the packing ring is inserted and a bearing insertion hole into which the bearing assembly is inserted.

In accordance with an embodiment of the present invention, the connection housing includes a packing ring fixing unit configured to have the packing ring insertion hole formed in the packing ring fixing unit and to surround the packing ring, a bearing fixing unit configured to have the bearing insertion hole formed in the bearing fixing unit and to surround the bearing assembly, and a connection unit configured to couple the packing ring fixing unit and the bearing fixing unit.

Furthermore, a sealing assembly in accordance with an embodiment of the present invention includes a packing device installed in a rotor shaft for sealing between a casing and the rotor shaft and supported by a foundation, a connection unit extended from the casing to the packing device and fixed to the casing so that the location of the connection unit is relatively changed with respect to the packing device, a sealing accommodation groove consecutively formed on one side of the connection unit in the circumferential direction of the connection unit, and a sealing device formed in the sealing accommodation groove and configured to have one end always come in contact with the packing device.

In accordance with an embodiment of the present invention, the sealing accommodation groove has a ring form and includes an opening whose some arc is open in the circumferential direction of the sealing accommodation groove.

In accordance with an embodiment of the present invention, the sealing device includes an elastic member of a ring shape, and part of the sealing device is seated in the sealing accommodation groove, and the remaining part of the sealing device is protruded through the opening. The protruded portion always comes in contact with the packing device regardless of a movement in the location of the connection unit.

In accordance with an embodiment of the present invention, the inside of the sealing device has a shape in which the elastic member having a specific thickness is wound.

In accordance with an embodiment of the present invention, the sealing accommodation groove includes a first accommodation unit, a second accommodation unit, and a third accommodation unit in its depth direction from the external surface of the connection unit. The second accommodation unit has a greater width than each of the first accommodation unit and the third accommodation unit. The first accommodation unit is open in the longitudinal direction of the connection unit.

In accordance with an embodiment of the present invention, the sealing device includes an elastic unit fixed to the third accommodation unit at the first end of the sealing device and has a second end protruded in a direction in which the first accommodation unit is open. The protruded portion of the second end always comes in contact with the packing device regardless of a movement in the location of the connection unit. The sealing device further includes a central part formed between the first end and the second end, accommodated in the second accommodation unit, and configured to have a width smaller than the second accommodation unit and greater than each of the first accommodation unit and the third accommodation unit.

Furthermore, a method of assembling a turbine in accordance with an embodiment of the present invention includes installing a foundation, installing a sealing assembly in the connection unit of a lower casing, installing the connection unit of the lower casing in the lower casing, installing the lower casing in the foundation, installing a lower packing device in the foundation, installing a lower bearing assembly in the connection housing or the foundation; installing a rotor shaft, installing an upper bearing assembly in the rotor shaft, installing the packing device in the rotor shaft, installing the sealing assembly in the connection unit of the upper casing, installing the connection unit of the upper casing in the upper casing, and installing the upper casing in the lower casing.

In accordance with an embodiment of the present invention, installing the sealing assembly in the connection unit of the lower casing includes forming a sealing accommodation groove at one end of the connection unit of the lower casing and installing the sealing device in the sealing accommodation groove.

In accordance with an embodiment of the present invention, installing the sealing assembly in the connection unit of the upper casing includes forming the sealing accommodation groove at one end of the connection unit of the upper casing and installing the sealing device in the sealing accommodation groove.

In accordance with the embodiments of the present invention, the packing device having the same support point as the bearing assembly that supports the rotor shaft is used. Accordingly, a clearance between the packing ring and the rotor shaft can be minimized because deformation of the casing does not have an influence on a movement in the location of the packing ring although the casing is deformed and thus there is no relative location movement between the packing ring and the rotor shaft. Accordingly, there is an advantage in that the leakage of a fluid within the casing or the introduction of a fluid or gas outside the casing can be reduced due to a reduction of the clearance.

Furthermore, in accordance with the embodiments of the present invention, although there is a relative location movement of the connection unit with respect to the packing device due to deformation of the casing, the space between the packing device and the connection unit can be sealed because the sealing assembly is adopted. Accordingly, there is an advantage in that the leakage of a fluid within the casing or the introduction of a fluid or gas outside the casing which may be generated between the packing device and the connection unit can be minimized.

DESCRIPTION OF REFERENCE NUMERALS

Figure 1:
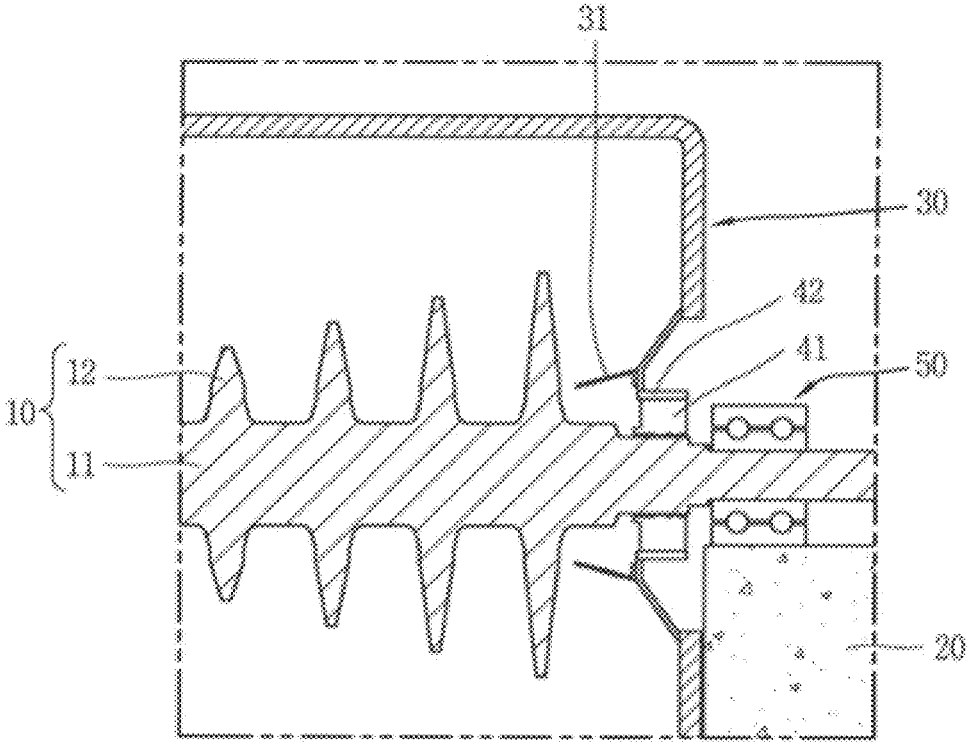
FIG. 1 is a side cross-sectional view schematically illustrating a conventional turbine.
Figure 2:
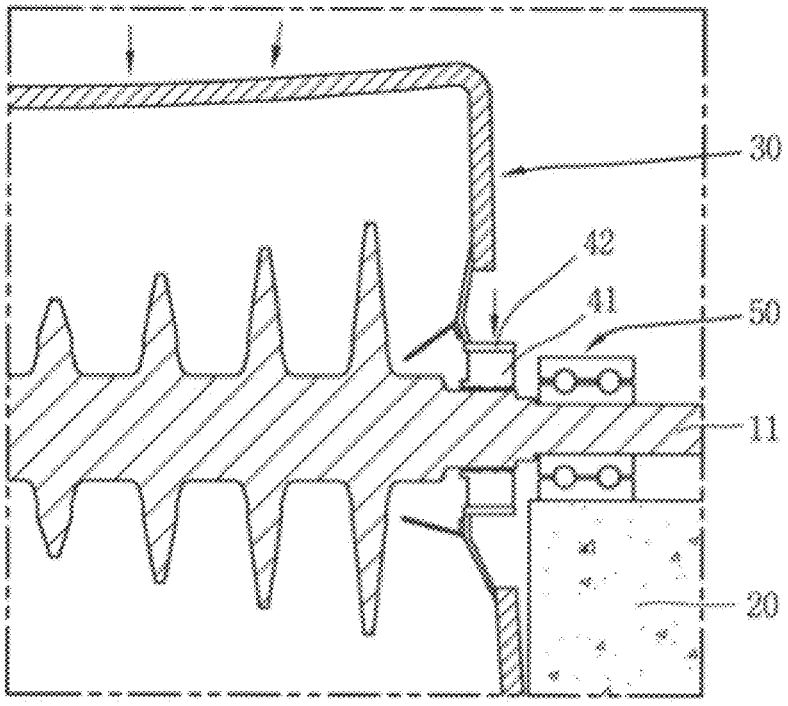
FIG. 2 is a side cross-sectional view illustrating the state in which vacuum pressure is applied to the turbine of FIG. 1.

100, 100', 100": turbine
111: rotor shaft
112: rotating blade
120: foundation
130: casing
140, 140': packing device
150: bearing assembly
160, 160', 160": connection unit

DETAILED DESCRIPTION

Reference will be now made in detail to embodiments of the present disclosure with reference to the attached drawings. It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the disclosure.

In the following embodiments, a steam turbine is illustrated as an example, but the present invention is not limited thereto. The spirit of the present invention may be applied to any turbine including a rotor shaft having rotating blades mounted on the passage of a fluid.

First, a turbine in accordance with an embodiment of the present invention is described in detail with reference to FIGS. 3 to 9.

Figure 3:
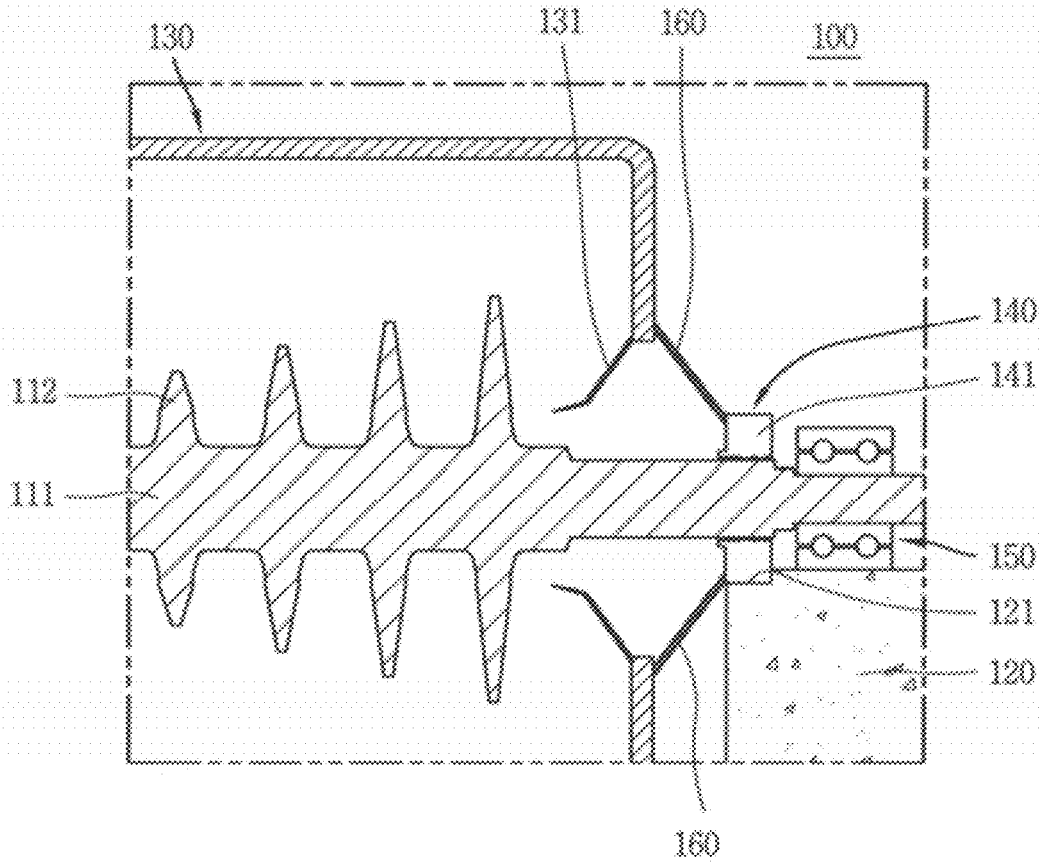
FIG. 3 is a side cross-sectional view schematically illustrating part of the turbine in accordance with an embodiment of the present invention.

Referring to FIG. 3, the turbine 100 in accordance with an embodiment of the present invention includes a rotor shaft 111 configured to have a plurality of rotating blades 112 mounted thereon, a casing 130, a bearing assembly 150 configured to rotatably support the rotor shaft 111, a foundation 120, that is, a structure for supporting the bearing assembly 150, and a packing device 140 configured to seal the space between the rotor shaft and the casing. Furthermore, although not illustrated, a fixing blade is provided between the rotating blades.

The casing 130 includes parts for generating rotatory power by a flow of steam and also includes a space that forms the passage of steam. The plurality of rotating blades 112 and the plurality of fixing blades are disposed in the space so that the rotor shaft 111 is rotated by thermal energy of the steam. The rotating blades and the fixing blades are known elements, and thus a detailed description thereof is omitted.

FIG. 3 is a schematic diagram of the structure of the downstream side in the passage of steam of the casing 130, that is, the structure of the steam discharge side. The casing 130 includes a discharge guide 131 provided on the downstream side of the passage of steam and configured to guide the discharge of steam to the outside of the casing 130.

The casing 130 further includes a connection unit 160 extended toward a packing device 140 and configured to support the packing device 140 in the state in which the connection unit 160 is fixed and connected to the casing 130 and comes in contact with the packing device 140, but is not fixed to the packing device 140.

On the side of the configuration, the connection unit 160 supporting the packing device 140 is fixed and connected to the casing 130, and the relative location of the connection unit 160 with respect to the packing device 140 can be changed. As a result, although the casing 130 is deformed, there is no influence on the packing device 140. Accordingly, a clearance for the design of the packing device 140 can be reduced, and a sealing effect can be improved. The connection unit 160 is described in detail later.

The bearing assembly 150 is provided outside the casing 130 and fixed and supported to the foundation 120. The bearing assembly 150 is configured to rotatably support the rotor shaft 111 and disposed close to the downstream side of the passage of steam, thus supporting the rotor shaft 111. The bearing assembly 150 has been known, and thus a detailed description thereof is omitted.

The packing device 140 is provided between the connection unit 160 and the rotor shaft 111, and functions to prevent steam from leaking through a gap between the casing 130 and the rotor shaft 111. The packing device 140 includes a packing ring 141 that surrounds the rotor shaft 111.

A plurality of irregularities is formed in the inner circumferential surface of the packing ring 141, and thus the inner circumferential surface of the packing ring 141 is engaged with the outer circumferential surface of the rotor shaft 111. The packing ring 141 may include any known labyrinth seal.

The foundation 120 is a structure that is fixed and supported to the packing ring 141. Furthermore, the foundation 120 supports the bearing assembly 150. A groove 121 into which the packing ring 141 is inserted is formed in the foundation 120. A method of fixing the packing ring 141 to the foundation 120 is not limited to the method using the groove. For example, the packing ring 141 may be fixed to the foundation 120 using a separate coupling member. The foundation 120 may be made of solid materials, such as concrete.

There is an advantage in that the packing ring 141 and the bearing assembly 150 have the same support point because both they are supported by the foundation 120 on the side of the configuration. Accordingly, there is an advantage in that the packing ring 141 can be firmly supported although it is not fixed and connected to the casing 130.

The connection unit 160 comes in contact with the packing ring 141, but it is fixed and connected to only the casing 130 and installed so that the location of the connection unit 160 is relatively changed with respect to the packing ring 141. The connection unit 160 may include a support leg fixed and connected to the casing 130 and extended toward the packing ring 141 so that the end of the support leg on the part of the packing ring 141 supports the packing ring 141. A plurality of the support legs may be provided and fixed to the casing 130 in a symmetrical form around the rotor shaft 111. If the connection unit 160 includes the plurality of support legs, the support legs are disposed so that steam does not leak therebetween.

Figure 4:
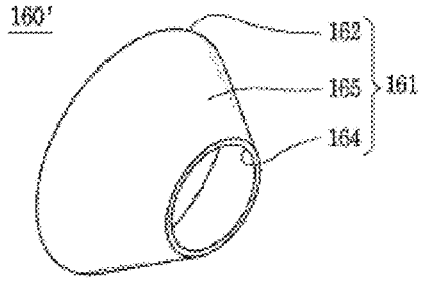
FIG. 4 is a perspective view illustrating a modified embodiment of a connection unit that forms the turbine in accordance with an embodiment of the present invention.

FIG. 4 is a perspective view illustrating a modified embodiment 160' of the connection unit. Referring to FIGS. 3 and 4, the connection unit 160' may include a taper unit 161 fixed and connected to the casing 130, extended in the length direction of the rotor shaft 111, and configured to have one end support the packing ring 141.

The taper unit 161 has a form in which it is narrowed toward the downstream side of the passage of steam. The taper unit 161 may include a taper wall 165 configured to have a first opening 162 and a second opening 164 having a smaller diameter than the first opening formed at both ends of the taper wall 165 and extended from the first opening to the second opening in such a way as to surround the rotor shaft 111.

The second opening 164 is disposed on the part of the packing ring 141 to support the side of the packing ring 141, and the first opening 162 is fixed to the casing 130. In this case, the second opening 164 has a diameter that is the same as or smaller than the diameter of the outer circumference of the packing ring 141.

Figure 5:
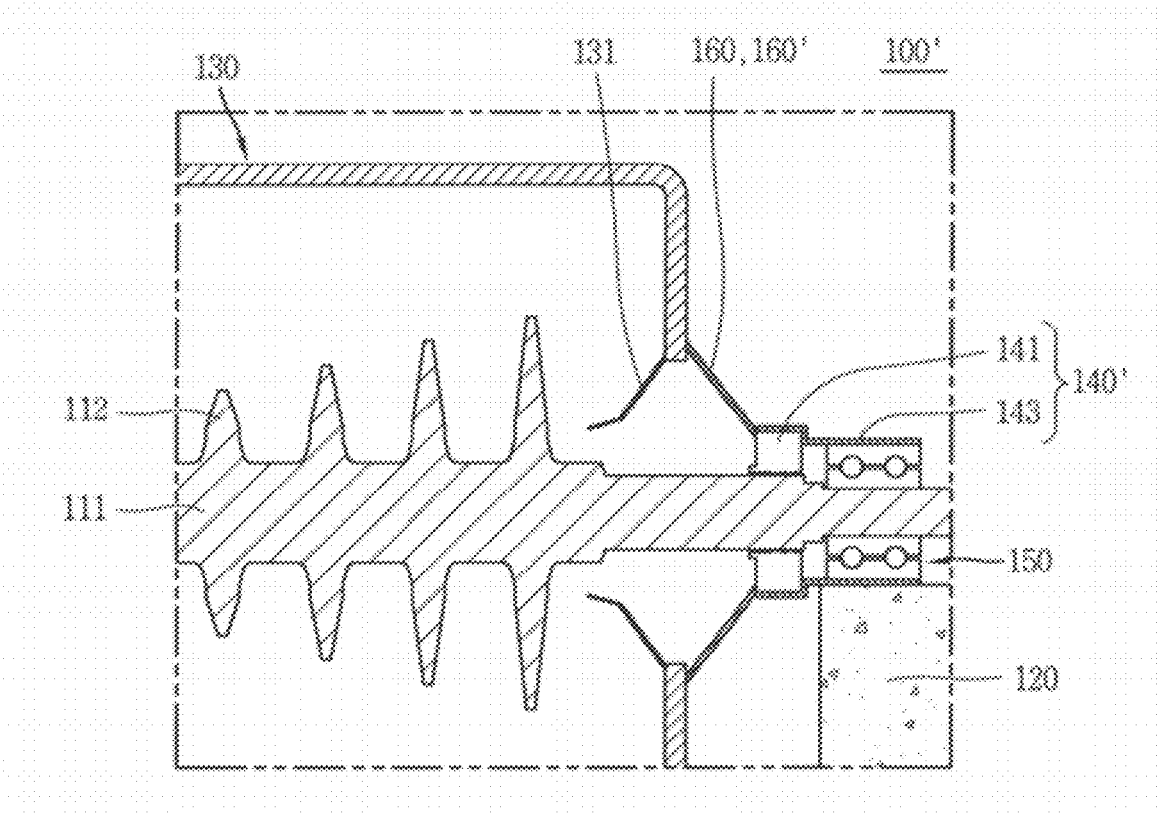
FIG. 5 is a side cross-sectional view schematically illustrating a modified embodiment of a packing device that forms the turbine in accordance with an embodiment of the present invention.

FIG. 5 is a side cross-sectional view schematically illustrating a modified embodiment 140' of the packing device that forms the turbine in accordance with an embodiment of the present invention. The modified embodiment 140' of the packing device that forms the turbine in accordance with an embodiment of the present invention has been modified from the packing device 140 of the aforementioned embodiment. In other words, the packing device 140 in accordance with an embodiment of the present invention is an embodiment in which the packing ring 141 is directly supported by the foundation 120. In contrast, the packing device 140' that forms a modified embodiment of the packing device of the present invention is an embodiment in which the packing device 140' further includes a connection housing 143 and it is supported by the foundation 120 through the connection housing 143. Hereinafter, the modified embodiment 140' of the packing device is described, and the same reference numerals as those of the aforementioned embodiment are used and a description thereof is omitted.

Figure 6:
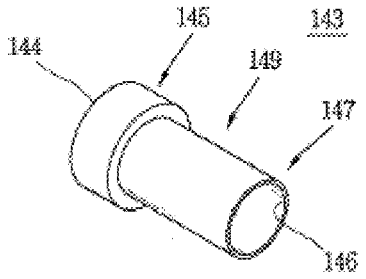
FIG. 6 is a perspective view of a connection housing that forms the embodiment of FIG. 5.

The modified embodiment 140' of the packing device includes the aforementioned packing ring 141 and further includes the connection housing 143 that couples the packing ring 141 and the bearing assembly 150. FIG. 6 is a perspective view of the connection housing 143.

Referring to FIGS. 5 and 6, the connection housing 143 has a cylindrical form in which a packing ring insertion hole 144 into which the packing ring 141 is inserted and a bearing insertion hole 146 into which the bearing assembly 150 is inserted are formed. In FIGS. 5 and 6, the connection housing 143 has been illustrated as having a stepped and cylindrical shape, but the present invention is not limited thereto. For example, the connection housing 143 may be modified to have any shape that couples the packing ring 141 and the bearing assembly 150 so that they are supported by the foundation 120. Furthermore, the connection housing 143 may be modified in various ways depending on the diameter of the packing ring 141 and the diameter of the bearing assembly 150.

For example, the connection housing 143 includes a packing ring fixing unit 145 configured to have the packing ring insertion hole 144 formed therein and to surround the packing ring 141, a bearing fixing unit 147 configured to have the bearing insertion hole 146 formed therein and to surround the bearing assembly 150, and a connection wall 149 configured to couple the packing ring fixing unit 145 and the bearing fixing unit 147.

The connection wall 149 includes a stepped jaw because the packing ring fixing unit 145 and the bearing the fixing unit 147 have different diameters. In some embodiments, the connection wall 149 may be formed with a slant.

The packing ring 141 may be formed to have the same support point as the bearing assembly 150 because the packing ring 141 and the bearing assembly 150 are accommodated in the single connection housing 143 on the side of the aforementioned configuration. The connection housing 143 is easily supported by the foundation 120.

Figure 7:
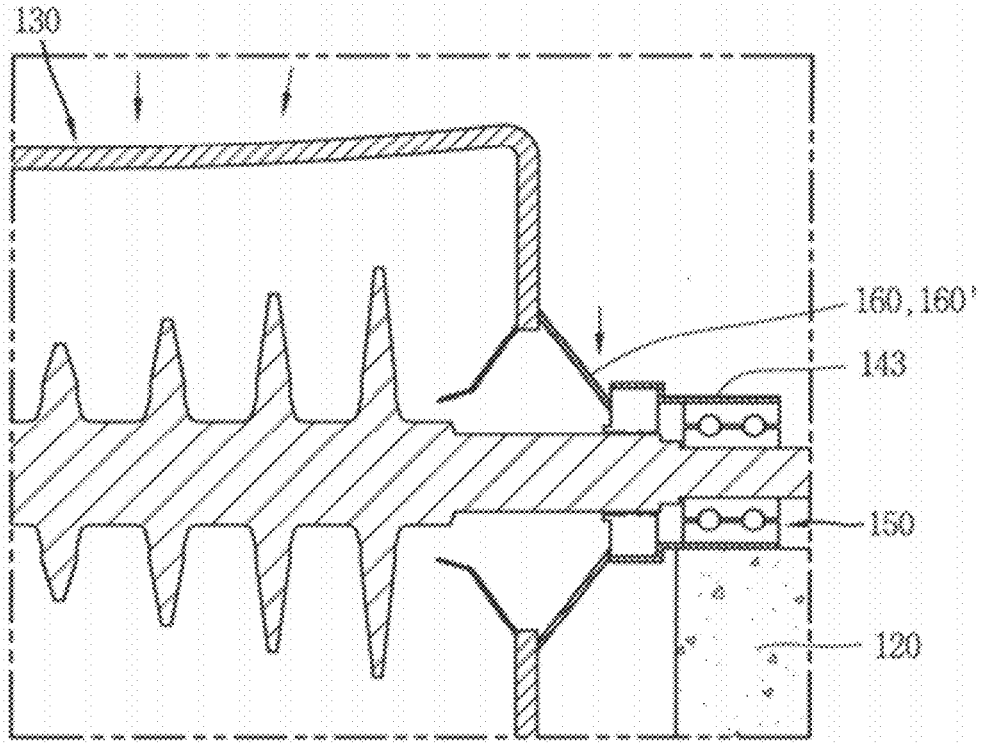
FIG. 7 is a side cross-sectional view illustrating the state in which vacuum pressure is applied to the embodiment of FIG. 5.

Referring to FIG. 7, although the casing 130 is moved in the direction of arrows due to a change of pressure in the aforementioned configuration, the packing ring 141 is not influenced by such a movement and is firmly supported by the foundation 120 through the medium of the connection housing 143. Furthermore, the connection unit 160, 160' extended from the casing 130 to the packing ring 141 support the side of the packing ring 141, but the locations thereof are relatively changed with respect to the packing ring 141.

Figure 8:
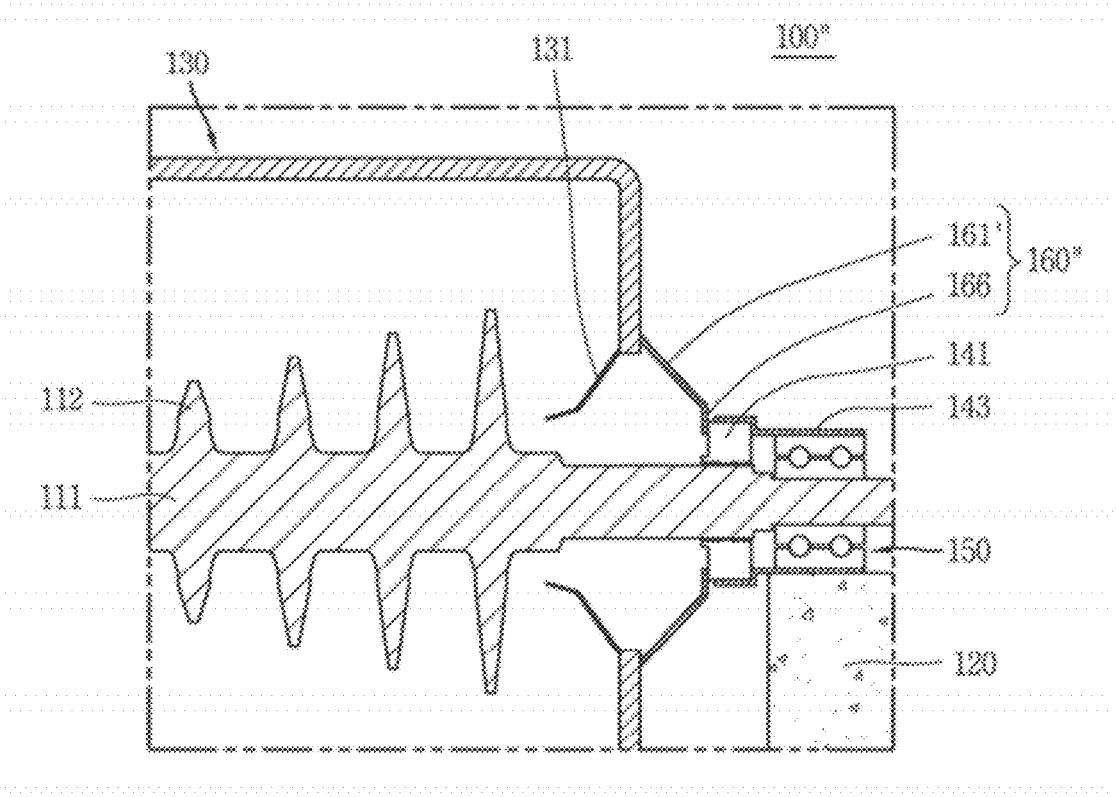
FIG. 8 is a side cross-sectional view illustrating another modified embodiment of the connection unit that forms the turbine in accordance with an embodiment of the present invention.

FIG. 8 is a side cross-sectional view illustrating another modified embodiment 160" of the connection unit that forms the turbine in accordance with an embodiment of the present invention. A turbine 100" according to yet another modified embodiment 160" includes a modified example 161' of the aforementioned taper unit, and the remaining elements are assigned the same reference numerals as those of the aforementioned embodiment and a description thereof is omitted.

The taper unit 161' may further include an extension wall 166 extended from the second opening 164 of the taper wall 165 to the rotor shaft 111, but extended along the side of the packing ring 141. The extension wall 166 can further improve a sealing effect.

Figure 9:
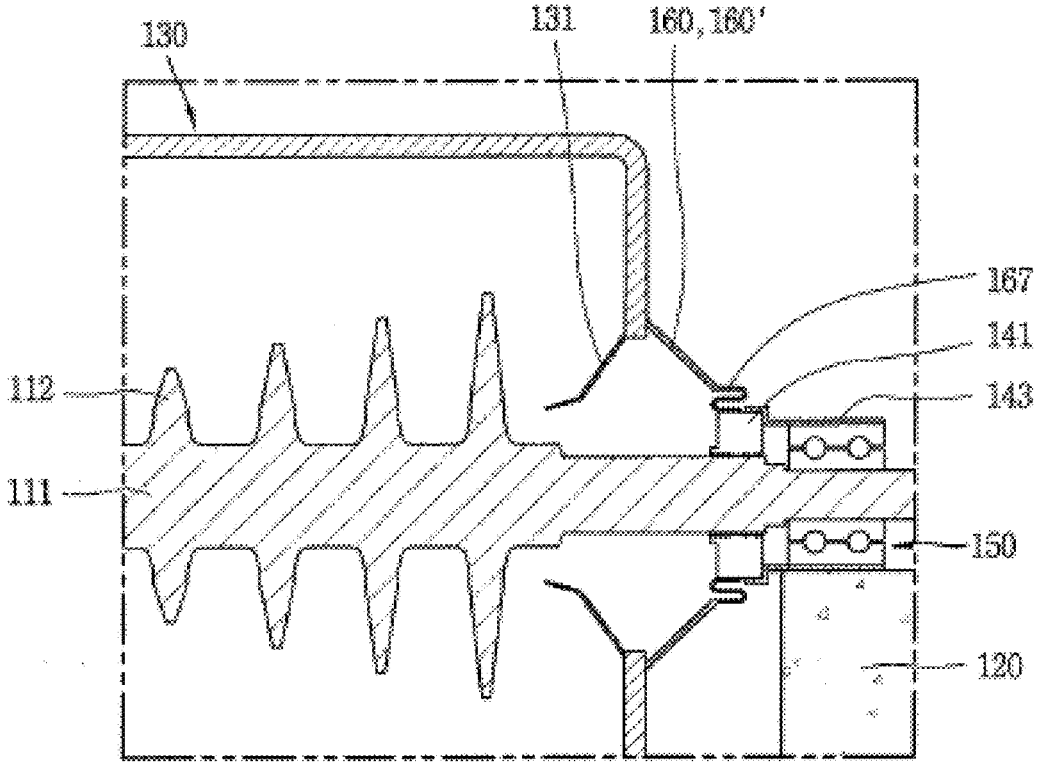
FIG. 9 is a side cross-sectional view illustrating an embodiment in which an elastic unit is included in the connection unit that forms the turbine in accordance with an embodiment of the present invention.

FIG. 9 is a side cross-sectional view illustrating an embodiment in which an elastic unit 167 is included in the connection unit 160, 160' that forms the turbine in accordance with an embodiment of the present invention. That is, the elastic unit 167 is provided in the aforementioned connection unit 160, 160'. The remaining elements are assigned the same reference numerals as those of the aforementioned embodiment, and a description thereof is omitted.

The elastic unit 167 is disposed between the taper unit 161 and the packing ring 141 and fixed to the taper unit 161. Furthermore, the elastic unit 167 may be made of materials having an elastic force or may be formed to be flexible by an elastic shape.

For example, the elastic unit 167 may be a circular gasket in which wrinkles have been formed. In this case, the gasket may be formed to have an outer circumferential surface fixed to the taper unit 161 and to have an inner circumferential surface surround the packing ring 141.

A sealing assembly in accordance with an embodiment of the present invention is described in detail below with reference to FIG. 10 to FIG. 14.

A part directly related to an element that belongs to the elements of in the turbine 100, 100', 100' and that functions as a sealing action between the packing device 140, 140' and the connection unit 160, 160' 160" may be called a sealing assembly 1000.

Figure 10:
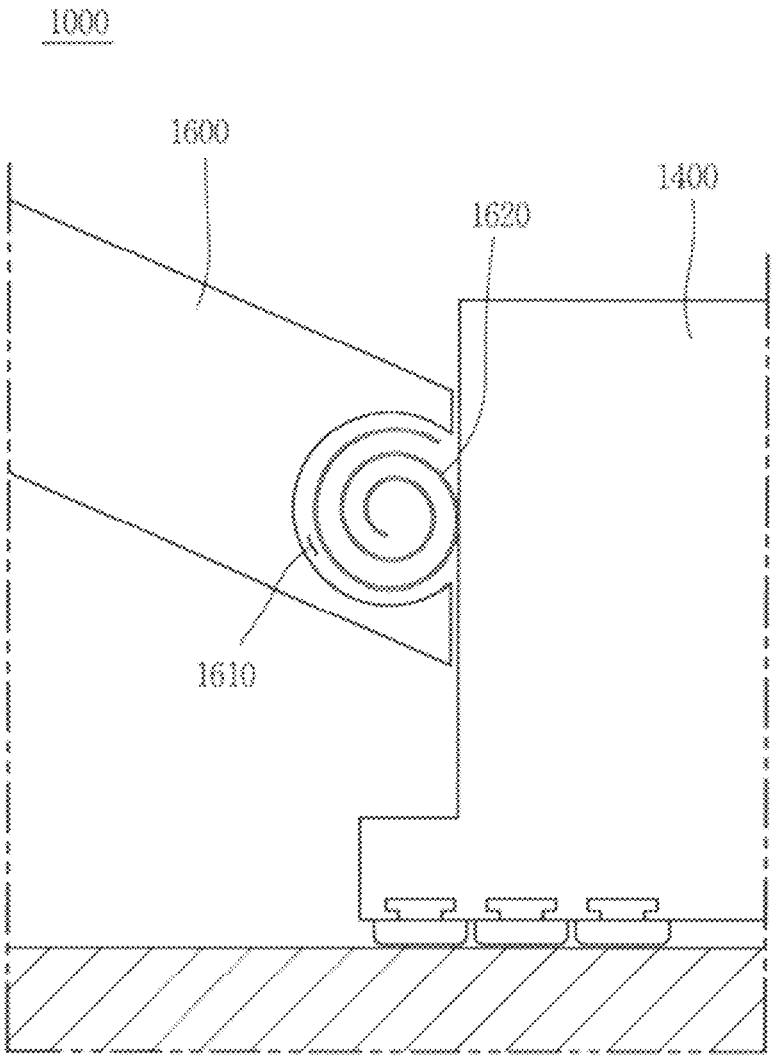
FIG. 10 is a side cross-sectional view schematically illustrating a sealing assembly in accordance with an embodiment of the present invention.

As illustrated in FIG. 10, the sealing assembly 1000 in accordance with an embodiment of the present invention includes a packing device 1400, a connection unit 1600, a sealing accommodation groove 1610, and a sealing device 1620.

The packing device 1400 and the connection unit 1600 correspond to the packing device 140, 140' and the connection unit 160, 160' 160" forming the turbine of the aforementioned embodiments or the modified embodiments thereof, and thus a detailed description thereof is omitted.

The sealing accommodation groove 1610 may be consecutively formed on one side of the connection unit 1600 in the circumferential direction of the connection unit 1600. For example, one side of the connection unit 1600 may be one side of the second opening 164 that forms the turbine 100', 100" in accordance with an embodiment of the present invention.

The sealing accommodation groove 1610 has a ring form and may have an opening in which part of the cylindrical groove of the sealing accommodation groove 1610 is open when the connection unit 1600 is viewed in a lateral cross section. The width of the opening may be smaller than the diameter of the groove.

Figure 11:
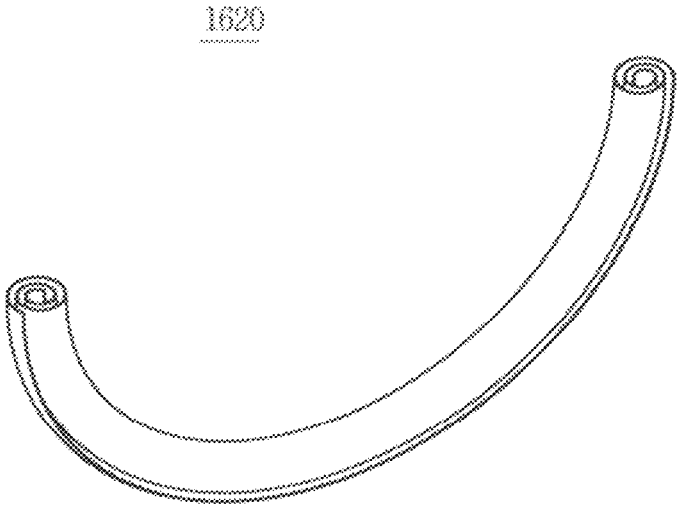
FIG. 11 is a perspective view schematically illustrating a connection unit that forms the embodiment of FIG. 10.
Figure 12:
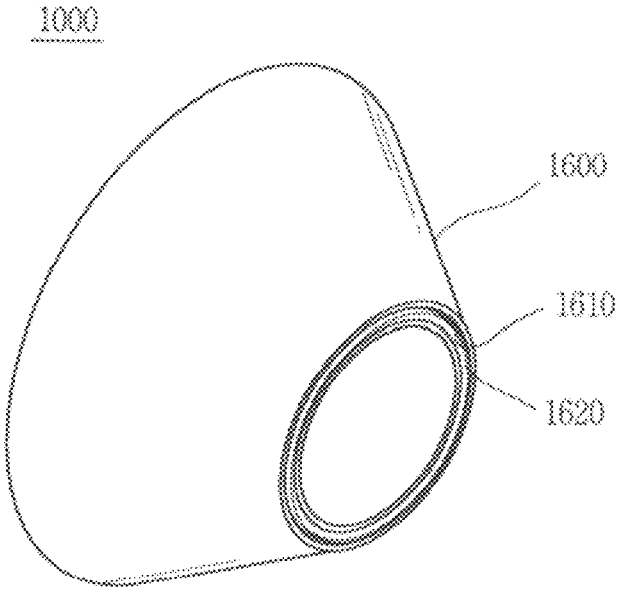
FIG. 12 is a perspective view schematically illustrating a sealing device that forms the embodiment of FIG. 10.

As illustrated in FIG. 11, the sealing device 1620 may be formed in a ring form so that it is inserted into the sealing accommodation groove 1610. Furthermore, the sealing device 1620 may be formed of an elastic member for the purpose of a sealing action for preventing the leakage of a fluid or the introduction of a fluid or gas which is generated between the packing device 1400 and the connection unit 1600. For example, the inside of the sealing device 1620 may have a form in which an elastic member having a specific thickness is wound. FIG. 12 is a perspective view of an embodiment of the connection unit 1600 in which the sealing device 1620 has been installed in the sealing accommodation groove 1610.

Referring back to FIG. 10, part of the sealing device 1620 is seated in the sealing accommodation groove 1610, and the remaining part thereof is protruded to the outside of the opening. Part of the protruded part comes in contact with one end of the packing device 1400.

Figure 13:
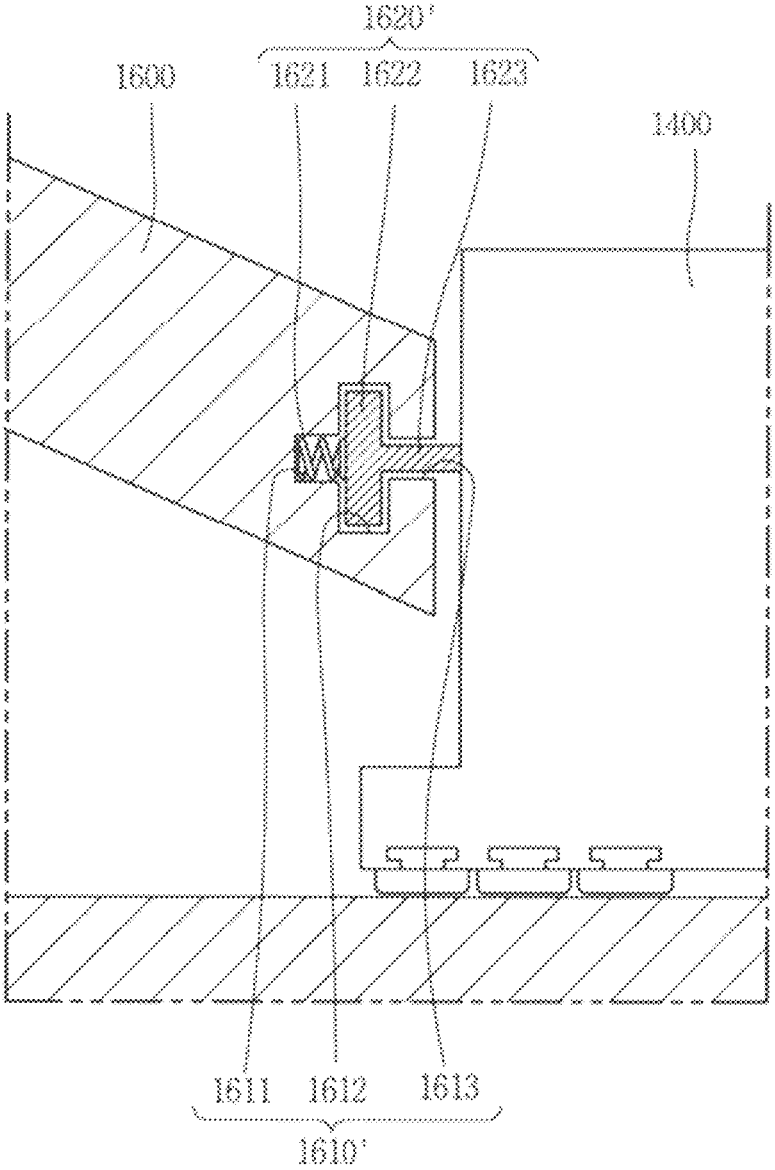
FIG. 13 is a side cross-sectional view schematically illustrating a modified embodiment of a sealing accommodation groove and a sealing device in accordance with an embodiment of the present invention.

FIG. 13 is a side cross-sectional view schematically illustrating a modified embodiment of the sealing accommodation groove and the sealing device in accordance with an embodiment of the present invention.

FIG. 13 is a side cross-sectional view schematically illustrating a modified embodiment 1610' of the sealing accommodation groove and a modified embodiment 1620' of the sealing device in accordance with an embodiment of the present invention. The modified embodiment 1610' of the sealing accommodation groove and the modified embodiment 1620' of the sealing device in accordance with an embodiment of the present invention have been modified from the sealing accommodation groove 1610 and sealing device 1620 of the aforementioned embodiment. In other words, the sealing accommodation groove 1610 and the sealing device 1620 in accordance with an embodiment of the present invention are formed on one side of the connection unit 1600 as described above. The modified embodiment 1610' of the sealing accommodation groove and the modified embodiment 1620' of the sealing device are also formed on one side of the connection unit 1600 like the sealing accommodation groove 1610 and the sealing device 1620 in accordance with an embodiment of the present invention. Furthermore, the sealing device 1620 in accordance with an embodiment of the present invention is formed of the elastic member of a ring shape and always brought in contact with one end of the packing device 1400. The sealing accommodation groove 1610 is formed so that the sealing device 1620 is accommodated in the connection unit 1600. The modified embodiment 1620' of the sealing device has a member having an elastic force in one end thereof in order to secure an elastic force and has the other end formed to always come in contact with the packing device 1400. The sealing accommodation groove 1610 is formed so that the other end of the modified embodiment 1620' is accommodated in the connection unit 1600. As described above, the modified embodiment 1620' has the same configuration and function as the sealing device 1620 in accordance with an embodiment of the present invention.

The modified embodiment 1610' of the sealing accommodation groove and the modified embodiment 1620' of the sealing device are described below. The remaining elements are assigned the same reference numerals as those of the aforementioned embodiment, and a description thereof is omitted.

As illustrated in FIG. 13, the sealing accommodation groove 1610' includes a first accommodation unit 1611, second accommodation unit 1612, and third accommodation unit 1613 that are formed in the depth direction of the connection unit 1600 from the outside surface of the connection unit 1600 on one side thereof. The sealing accommodation groove 1610' is formed on one side of the connection unit 1600 in the circumferential direction of the connection unit 1600, but may have a "+" shape when the connection unit 1600 is viewed in a lateral cross section. Accordingly, the second accommodation unit 1612 has a greater width than the first accommodation unit 1611 and the third accommodation unit 1613. Furthermore, the first accommodation unit 1611 may be open in the longitudinal direction of the connection unit 1600 so that the protruded portion of the sealing device 1620' is protruded from the sealing accommodation groove 1610 toward one end of the packing device 1400.

Figure 14:
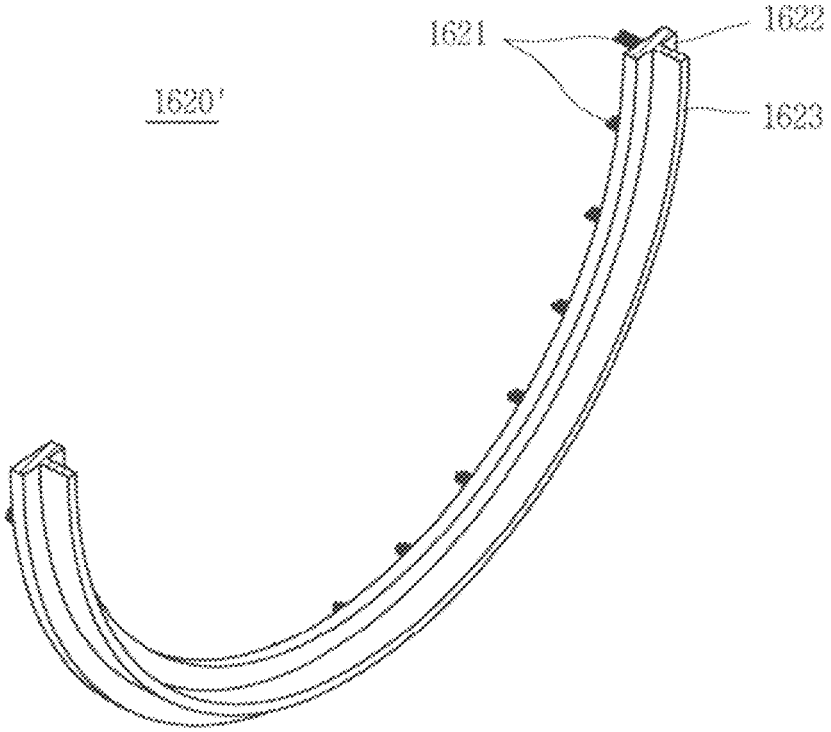
FIG. 14 is a perspective view schematically illustrating the sealing device that form the embodiment of FIG. 13.

The sealing device 1620' includes an elastic unit 1621 fixed to the first accommodation unit 1611 on one end of the sealing device 1620', a protrusion 1623 protruded in the direction in which the third accommodation unit 1613 is open on the other end of the sealing device 1620', and a central part 1622 accommodated in the second accommodation unit 1612 at the center of the sealing device 1620'. The protruded portion of the protrusion 1623 always comes in contact with the packing device 1400 regardless of a movement in the location of the connection unit 1600. The central part 1622 has a smaller width than the second accommodation unit 1612, but may have a greater width than the first accommodation unit 1611 and the third accommodation unit 1613. For example, the elastic unit 1621 may be a spring. FIG. 14 is an embodiment of the sealing device 1620'.

The packing device 140, 140' that forms the turbine 100' 100" in accordance with an embodiment of the present invention on the side of the aforementioned configuration is not moved because it has the same support point as the bearing assembly 150 supporting the rotor shaft 111 although the casing 130 is deformed. In contrast, the location of the connection unit 160, 160' is changed when the casing 130 is deformed because the connection unit 160, 160' is fixed and supported by the casing 130. Accordingly, as illustrated in FIG. 7, there is a problem in the leakage of a fluid within the casing 130 or the introduction of a fluid or gas outside the casing 130 between the connection unit 1600 and the packing device 1400 because the location of the connection unit 1600 is relatively moved with respect to the packing device 1400. In contrast, the present embodiment is advantageous in that a sealing effect can be improved because the sealing device 1620, 1620' has an elastic force and part of the sealing device 1620, 1620' always comes in contact with one end of the packing device 1400 regardless of such a relative location movement.

In some embodiments, the sealing accommodation groove 1610, 1610' and the sealing device 1620, 1620' are not formed in the connection unit 1600, but may be likewise formed in the packing device 1400.

A method of assembling the turbine in accordance with an embodiment of the present invention is described in detail below with reference to FIG. 15.

Figure 15:
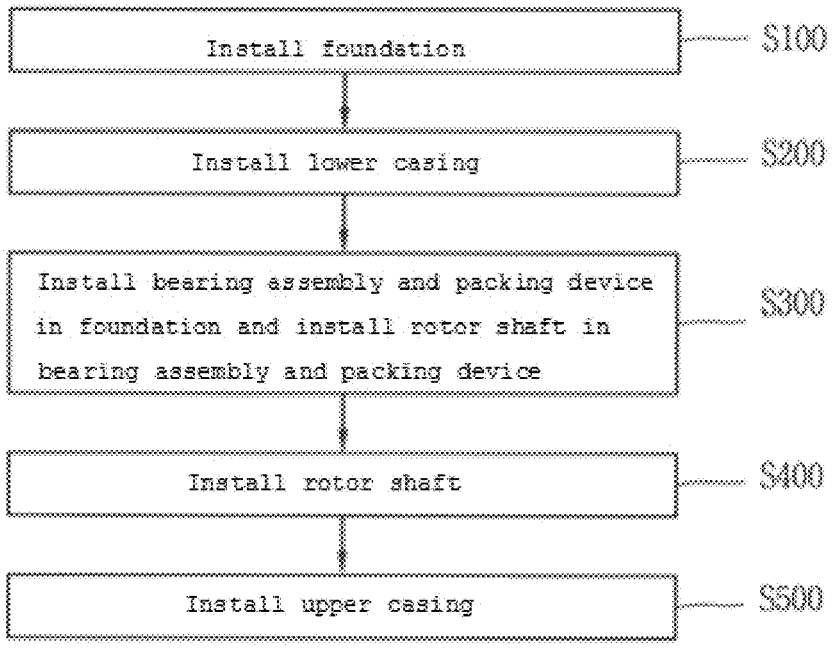
FIG. 15 is a flowchart illustrating a method of assembling the turbine in accordance with an embodiment of the present invention.

As illustrated in FIG. 15, the method of assembling the turbine 100, 100', 100" in accordance with an embodiment of the present invention includes installing the foundation at step S100, installing a lower casing at step S200, fixing the bearing assembly and the packing device so that they are supported by the foundation and installing the rotor shaft so that it is supported by the bearing assembly and the packing device at step S300, and installing the upper casing at step S400.

Steps S100 to S400 are described in detail below.

First, the foundation 120 that supports and fixes the elements of the turbine 100, 100" in accordance with an embodiment of the present invention is installed.

Thereafter, before the lower casing 130 is installed in the foundation 120, the connection unit 160, 160' is installed at one end of the casing 130, and the sealing assembly 1000, 1000' is installed in the connection unit 160, 160.'

Installing the sealing assembly 1000, 1000' in the connection unit 160, 160' includes forming the sealing accommodation groove 1610, 1610' at one end of the connection unit and installing the sealing device 1620, 1620' in the sealing accommodation groove 1610, 1610.'

Thereafter, the bearing assembly 150 and the packing device 140, 140' are installed in the foundation 120, and the rotor shaft 111 is installed in the bearing assembly 150 and the packing device 140, 140.'

In this case, prior to the operation of the turbine 100, 100', 100", the elastic force of the sealing device 1620, 1620' is controlled so that the protruded portion of the sealing device 1620, 1620' applies specific pressure to the packing device 140, 140'. Accordingly, the protruded portion of the sealing device 1620, 1620' performs a sealing action while always coming in contact with the packing device 140, 140' although there is a relative location movement between the connection unit 160, 160' and the packing device 140, 140.'

Accordingly, the assembly of elements that belong to the elements of the turbine 100, 100', 100" in accordance with an embodiment of the present invention and that form the elements of a lower half part is completed.

The assembly of the elements of the remaining upper half part is performed in reverse order of steps S100~S300. That is, the packing device 140, 140' and the bearing assembly 150 are installed in the rotor shaft 111, and the upper casing 130 is installed over the lower casing 130. As in the lower casing 130, the connection unit 160, 160' is installed in the upper casing 130, and the sealing assembly 1000, 1000' is installed in the connection unit 160, 160.' As in the sealing assembly 1000, 1000' of the connection unit 160, 160' installed in the lower casing 130, the sealing accommodation groove 1610, 1610' and the sealing device 1620, 1620' are installed in the sealing assembly 1000, 1000' of the connection unit 160, 160' installed in the upper casing 130. Furthermore, the task for controlling an elastic force is also performed for the purpose of a sealing action between the connection unit 160, 160' and the packing device 140, 140.'

Further, the embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

What is claimed is:

1. A turbine, comprising:

a rotor shaft having a plurality of rotating blades mounted on the rotor shaft;

a bearing assembly rotatably supporting the rotor shaft;

a casing forming a passage of a fluid and comprising a space in which the rotating blades are disposed so that thermal energy of the fluid is converted into mechanical energy by rotation;

a foundation fixedly supporting the bearing assembly; and a packing device installed on the rotor shaft for sealing between the casing and the rotor shaft and supported by the foundation, wherein the casing comprises a connection unit extended toward the packing device, wherein the connection unit is fixed to the casing and the connection unit contacts the packing device without being fixed to the packing device, so that upon deformation of the casing, the connection unit moves without causing the packing device to move, so that there is no relative movement between the packing device and the rotor shaft.

2. The turbine of claim 1, wherein:

the casing further comprises a discharge guide of the fluid provided on a downstream side of the passage of the fluid, and the connection unit extends from the discharge guide to the packing device.

3. The turbine of claim 1, wherein the connection unit comprises a taper unit extended in a length direction of the rotor shaft.

4. The turbine of claim 3, wherein:

the taper unit has a shape in which the taper unit is narrowed toward a downstream side of the passage of the fluid, the taper unit has a first opening and a second opening having a smaller diameter than the first opening, the taper unit comprises a taper wall extended from the first opening to the second opening so as to surround the rotor shaft, and a second opening side of the taper wall is disposed in the packing device, and a first opening side of the taper wall is fixed to the casing.

5. The turbine of claim 4, wherein the taper unit further comprises an extension wall extended from the second opening side of the taper wall toward the rotor shaft and disposed along a side of the packing device.

6. The turbine of claim 5, further comprising a sealing assembly formed between the second opening side of the taper wall and the packing device.

7. The turbine of claim 3, wherein:

the connection unit further comprises an elastic unit disposed between the taper unit and the packing device, fixed to the taper unit, and having an elastic force, and the elastic unit comprises a circular gasket in which wrinkles are formed.

8. The turbine of claim 7, wherein:

the gasket has an outer circumferential surface fixed to the taper unit and has an inner circumferential surface surrounding the packing device, and the packing device comprises a packing ring installed to surround an outer circumferential surface of the rotor shaft.

9. The turbine of claim 8, wherein:

the bearing assembly is provided on a side adjacent to a downstream side of the passage of the fluid outside the casing, and the packing ring is disposed between the connection unit and the bearing assembly.

10. The turbine of claim 9, wherein at least part of the packing ring is fixed and supported to the foundation.

11. The turbine of claim 10, wherein:

the packing device further comprises a connection housing coupling the packing ring and the bearing assembly, and the foundation supports the connection housing.

12. The turbine of claim 11, wherein:

the connection housing comprises:

a packing ring insertion hole into which the packing ring is inserted and a bearing insertion hole into which the bearing assembly is inserted, and the connection housing comprises:

a packing ring fixing unit having the packing ring insertion hole formed in the packing ring fixing unit and to surround the packing ring;

a bearing fixing unit having the bearing insertion hole formed in the bearing fixing unit and to surround the bearing assembly; and a connection wall coupling the packing ring fixing unit and the bearing fixing unit.

* * * * *